US007106277B2

(12) United States Patent
Ando et al.

(10) Patent No.: US 7,106,277 B2
(45) **Date of Patent: *Sep. 12, 2006**

(54) IMAGE DISPLAY APPARATUS AND METHOD

(75) Inventors: Muneki Ando, Atsugi (JP); Osamu Sagano, Sagamihara (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154 (a)(2).

Subject to any disclaimer, the term of this patent is extended or adjusted under 35 U.S.C. 154(b) by 0 days.

(21) Appl. No.: 09/484,432

(22) Filed: Jan. 18, 2000

(65) Prior Publication Data

US 2003/0117420 A1 Jun. 26, 2003

(30) Foreign Application Priority Data

Feb. 23, 1999 (JP) ..... 11-045531
Dec. 24, 1999 (JP) ..... 11-366624

(51) Int. Cl.
*G09G 3/36* (2006.01)

(52) U.S. Cl. ..... 345/58; 345/691; 348/609

(58) Field of Classification Search ..... 345/58, 345/65, 55, 56, 74.1, 76, 691, 90, 208, 44, 345/46, 1.3, 63, 77; 315/169.2, 169.3; 348/609, 348/608, 626

See application file for complete search history.

(56) References Cited

U.S. PATENT DOCUMENTS 4,626,898 A * 12/1986 Baba et al. ..... 348/279
5,418,574 A * 5/1995 Miyabata et al. ..... 348/625
5,521,611 A * 5/1996 Okada et al. ..... 345/89
5,646,643 A * 7/1997 Hirai et al. ..... 345/100
5,654,607 A * 8/1997 Yamaguchi et al. ..... 313/495
5,841,411 A * 11/1998 Francis ..... 345/58
5,867,593 A * 2/1999 Fukuda et al. ..... 382/176
5,943,094 A * 8/1999 Sakai et al. ..... 348/243
5,969,713 A * 10/1999 Tomizawa et al. ..... 345/198
6,115,018 A * 9/2000 Okumura et al. ..... 345/95
6,195,076 B1 * 2/2001 Sakuragi et al. ..... 345/74.1
6,195,077 B1 * 2/2001 Gyouten et al. ..... 345/99
6,445,367 B1 * 9/2002 Suzuki et al. ..... 345/75.2

FOREIGN PATENT DOCUMENTS

JP 09-265925 * 10/1997

* cited by examiner

*Primary Examiner*—Richard Hjerpe
*Assistant Examiner*—Abbas I. Abdulselam
(74) *Attorney, Agent, or Firm*—Fitzpatrick, Cella, Harper & Scinto

(57) ABSTRACT

The effect of the fluctuation of a signal that is caused by interference between the lines of an image display apparatus can be reduced. For this purpose, an image display apparatus comprises a plurality of lines, a plurality of display devices to which signals are respectively transmitted along the lines, and a signal circuit for generating the signals. The signal circuit outputs a signal having a duration, which is equivalent to a high-level period, that has been corrected in accordance with the length of a high-level period for a signal that is to be transmitted to an adjacent line of each line or in accordance with the number of times the level of a signal that is to be transmitted to an adjacent line is changed during the high-level period, or in order to reduce a change in luminance due to a level change for a signal that is to be transmitted to an adjacent line. Preferably, to correct a luminance signal that is input to terminal d, a crosstalk correction unit employs for its own line luminance signals for adjacent lines.

6 Claims, 14 Drawing Sheets

IMAGE DISPLAY APPARATUS AND METHOD

BACKGROUND OF THE INVENTION

1. Field of the Invention

The present invention relates to an image display apparatus and to a method for employing a display device to display an image. In particular, the present invention pertains to an arrangement for forming an image on a plane.

2. Related Background Art

FIG. 15 is a diagram illustrating a conventional image display apparatus that displays an image by employing pulse width modulation for which all start times for driving modulation signals are identical. FIG. 16 is a timing chart showing the operational timing for the image display apparatus. In FIG. 15, the image display apparatus comprises: a timing controller 1, for generating the operational timing for the apparatus; an A/D converter 2, for converting an image signal S1 into a digital signal S2 representing the luminance of each pixel; a display panel 4, across which display devices are distributed, one at each intersection of lines arranged as columns and rows; a column selection controller 3, for controlling the selection of the lines arranged as columns on the display panel 4; a shift register 5, for distributing the digital image signal S2; PWM generators 6, for performing pulse width modulation for a luminance signal received by the shift register 5 and for controlling the display luminance; and a row driver 7, which includes the shift register 5 and the PWM generators 6.

With this arrangement, an input image signal S1 is converted by the A/D converter 2 into a digital signal S2 representing the luminance of each pixel, and the digital signal is transmitted to the PWM generator 6 for a pixel. Each of the PWM generators 6 employs a signal from the timing controller 1 to modulate the luminance signal to obtain a pulse length, and drives a line arranged as a row on the display panel 4. At the same time, the column selection controller 3 sequentially drives a column corresponding to a pixel that is to be displayed. Individual devices can therefore be driven in accordance with the image signals.

The structure of a PWM generator 6 is shown in FIG. 17, and the operational timing is shown in FIG. 19. In FIG. 17, a clock generator 10 supplies a clock pulse S10. Upon the arrival of the clock pulse at a terminal CK, a down counter 11 decrements by one the value held by an internal register ct (not shown). When the counter value reaches 0, the counting by the down counter 11 is halted and a terminal NZ is set high. Then, when a pulse is input at a terminal LOAD, the down counter 11 loads an input value DATA into the internal register, and resumes the counting. And an output driver 12 receives the level set for the terminal NZ of the down counter 11 and drives the display panel 4.

A signal S11 received at the terminal LOAD of the down counter 1 is a timing signal for loading the luminance signal S12, and is either a horizontal synchronization signal or another signal based on it. The luminance signal S12 input at the terminal DATA is a digital luminance signal; a signal S13 (FIG. 19) is a value held in the register ct of the down counter 11; a signal S14 goes high when the internal register value S13 is other than 0; and a signal S15 emitted by the output driver 12 is a modulation signal output in accordance with the signal S14.

In FIG. 15, the thus arranged PWM generator 6 performs the above operation to modulate into a pulse length the luminance signal received from the shift register 5, and outputs the resultant signal to the display panel 4.

In the arrangement in FIG. 15, for example, a floating capacitance called an inter-line capacitance is present between the individual lines of the display panel 4. If a drive signal having a waveform shown in FIG. 20 is to be transmitted to the n-th line, for example, the signal for the n-th line is affected by the trailing edges of drive signals that are transmitted to the adjacent (n−1)th and (n+1)th lines, and its waveform is distorted as is shown in FIG. 21. This occurs because of crosstalk induced by inter-line capacitance.

SUMMARY OF THE INVENTION

To resolve the above shortcomings, it is one objective of the present invention to provide an image display apparatus whereby a satisfactory image can be displayed, and an image display method whereby display of a satisfactory image can be ensured.

To achieve the above objective, according to a first aspect of the present invention, an image display apparatus comprises a plurality of column wirings each connected to a respective display device, and at least one row wiring, connected to the display devices. A respective pulse width modulator is provided for each column wiring for outputting, for each column wiring, a modulation signal, and a cross-talk correction arrangement controls operation of the pulse width modulator for a predetermined one of the column wirings such that the modulation signal to be applied to that column wiring is corrected so as to inhibit an effect, on luminance in relation to that modulation signal, of deformation of the waveform of that modulation signal as a result of a level change of the modulation signal supplied to an adjacent column wiring during the application of the modulation signal to the predetermined column wiring. The cross-talk correction arrangement for this purpose comprises a respective cross-talk correction circuit for each of the column wirings.

DETAILED DESCRIPTION OF THE PREFERRED EMBODIMENTS

According to the preferred embodiments of the present invention, a correction means is addition means for adding together a luminance signal and a correction signal or a pulse delay means for employing a correction signal to extend a period for applying the pulse of a modulation signal, and a conversion means is an analog-digital converter. Also, in order to display an image, while a line arranged as a column is selected, a drive means transmits a drive signal to a line arranged as a row, and a correction signal generation means generates a correction signal for each like arranged line based on a luminance signal or a modulation signal for a like arranged adjacent line.

The modulation means employs pulse width modulation (PWM) as a modulation method, and when the modulation method employed by the modulation means is pulse width modulation, whereby an identical start time is used for driving a modulation signal for each line arranged as a row, the correction signal generation means either generates a correction signal, with which the strength of a luminance signal for each line arranged as a row is increased when it is stronger than a luminance signal for a like arranged adjacent line, or generates a correction signal, with which a luminance signal for each line arranged as a row is extended when it is longer than the pulse of a modulation signal for a like arranged adjacent line. When the modulation method employed by the modulation means is pulse width modulation, in accordance with an end time, for the driving of a modulation signal, that is identical for each line arranged as a row, the correction signal generation means generates a correction signal, with which the strength of a luminance signal for a line arranged as a row is reduced when it is stronger than a luminance signal for a like arranged adjacent line. The drive means uses a constant current to drive the display devices, and in this case, since the fluctuation of a modulation signal due to crosstalk is especially remarkable, the present invention is effective. The display devices, which are electron emission devices that form images by irradiating phosphors with the electron beams that they emit, can be surface conductive electron emission devices, FE electron emission devices, or MIM electron emission devices.

The preferred embodiments of the present invention will now be described while referring to the accompanying drawings.

First Embodiment

Figure 1:
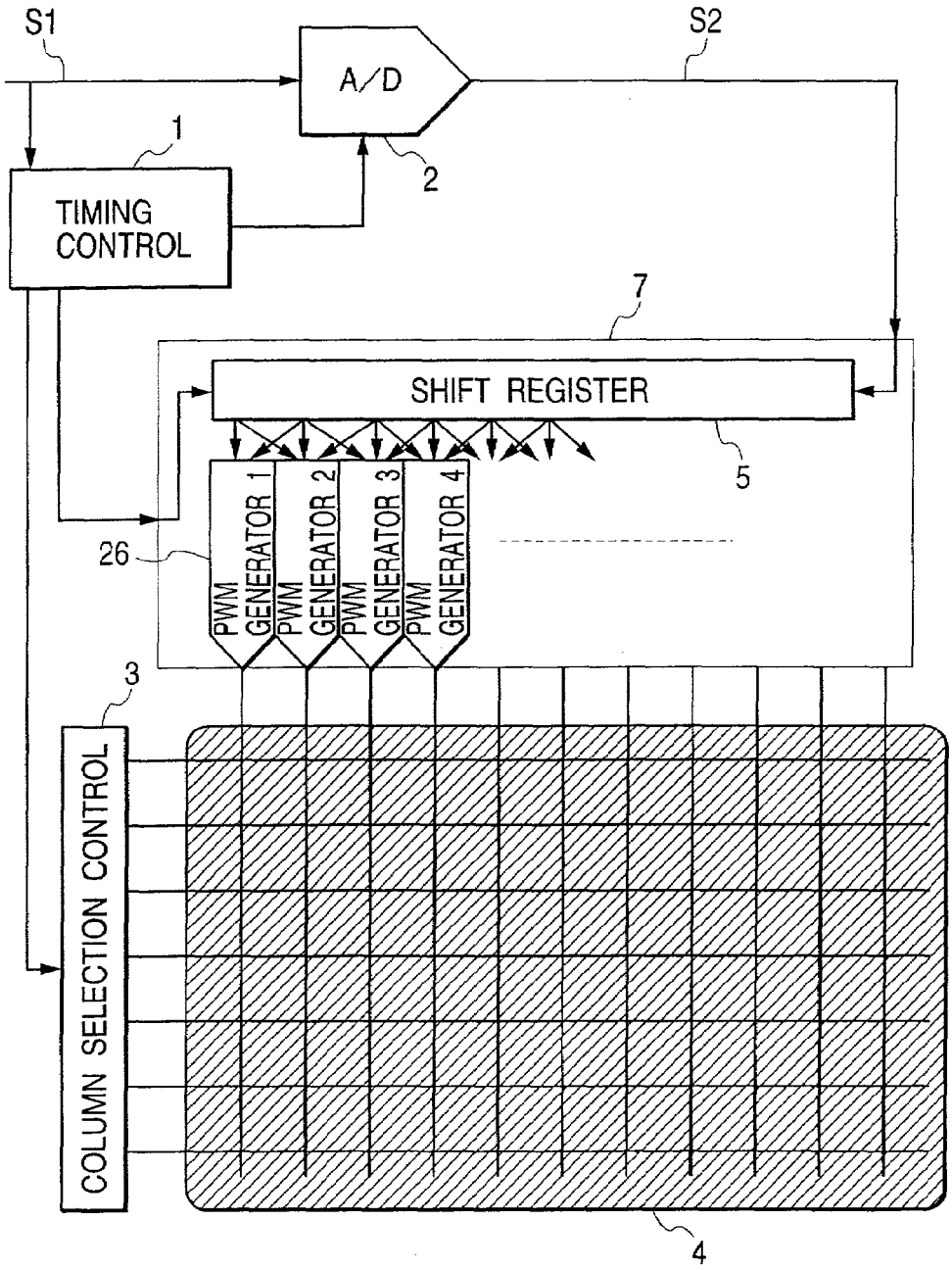
FIG. 1 is a block diagram illustrating the arrangement of an image display apparatus according to a first embodiment of the present invention.
Figure 16:
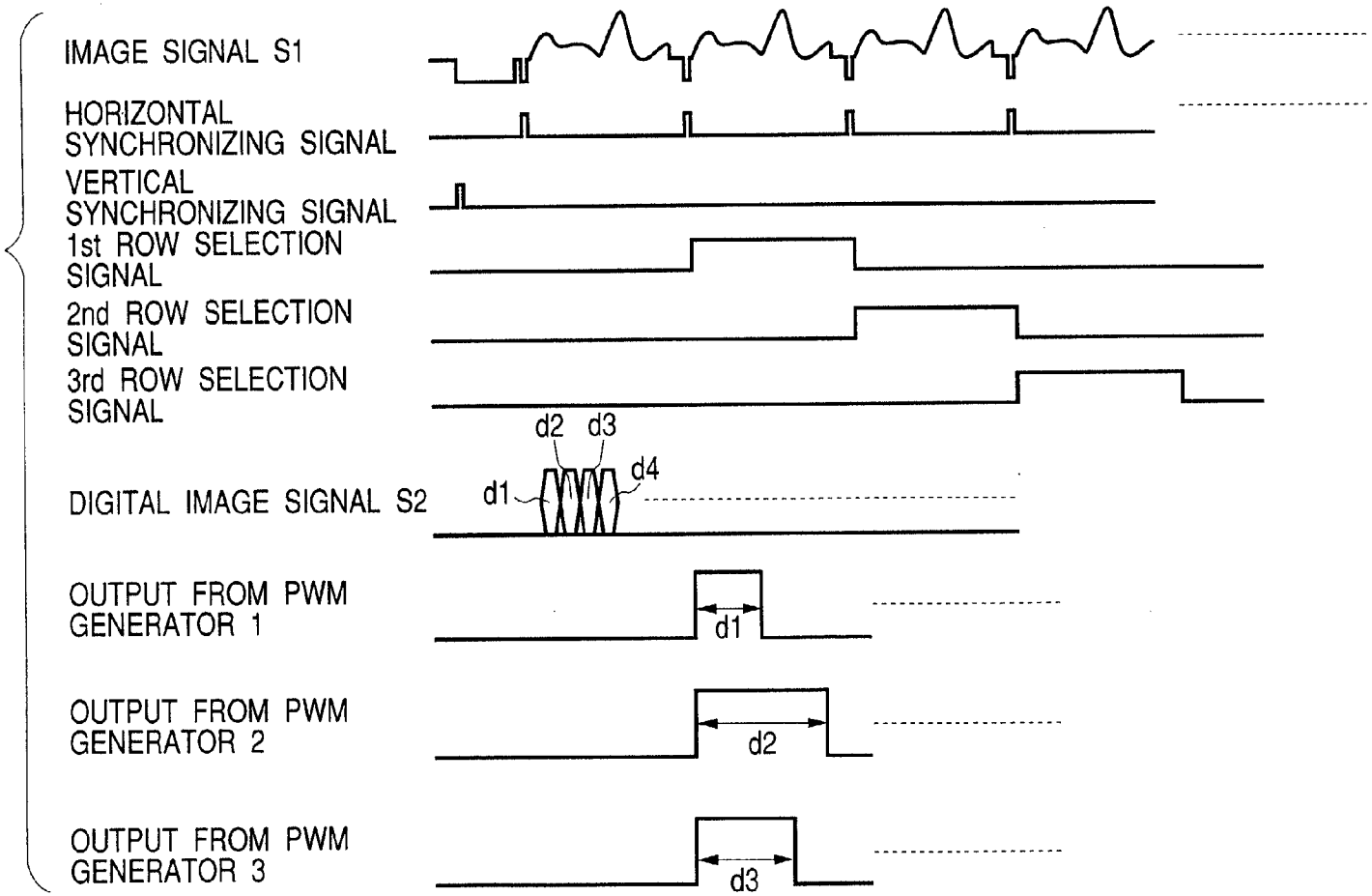
FIG. 16 is a timing chart for the operation of the display device in FIG. 15.
Figure 17:
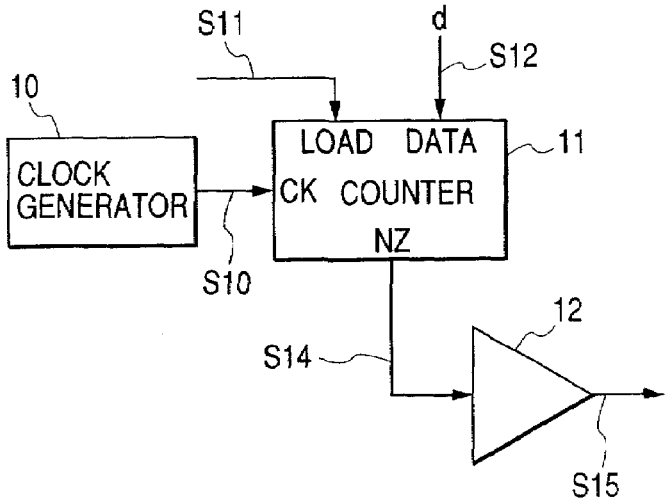
FIG. 17 is a block diagram illustrating the arrangement of a PWM generator in the apparatus in FIG. 15.
Figure 18:
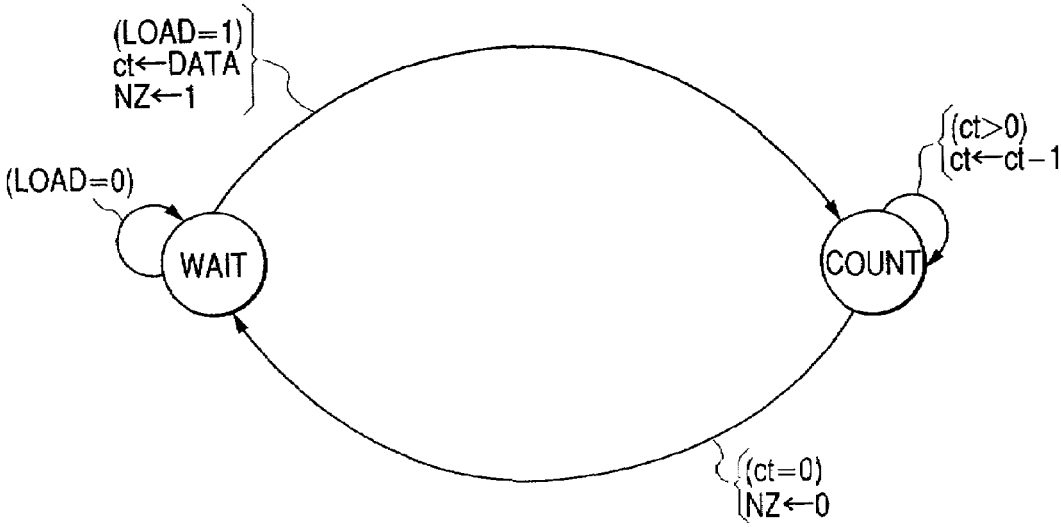
FIG. 18 is a diagram showing the shifting of the operating state of the PWM generator of the apparatus in FIG. 15.
Figure 19:
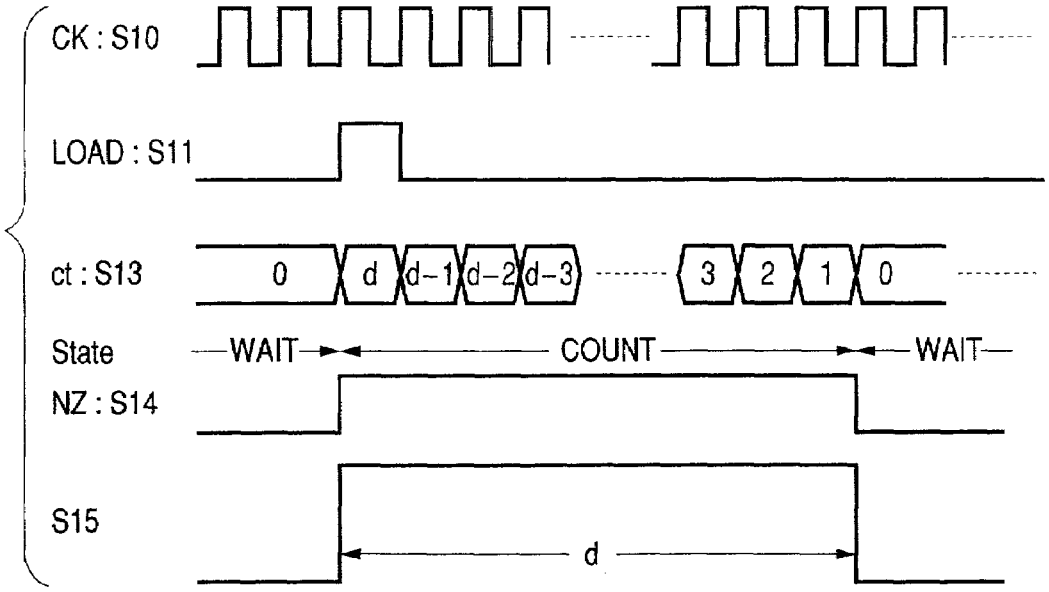
FIG. 19 is a timing chart for the operation of the PWM generator of the apparatus in FIG. 15.
Figure 20:
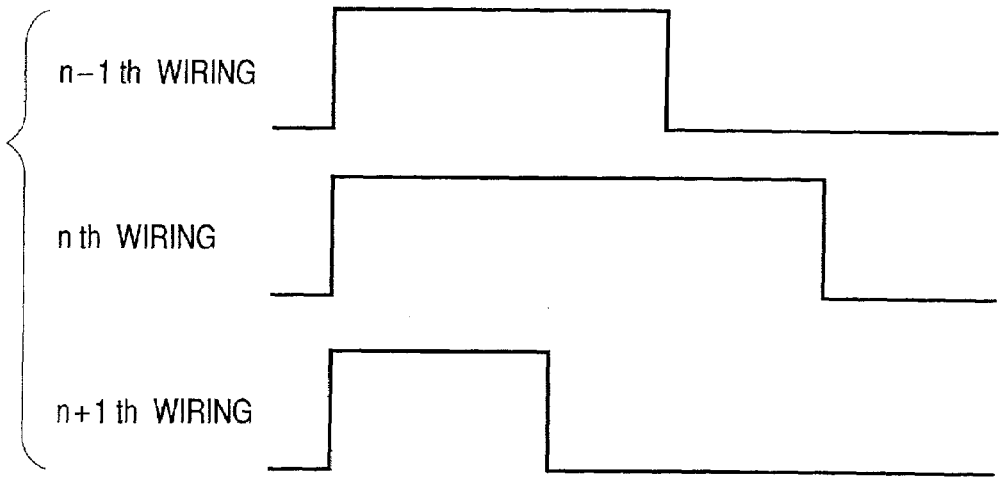
FIG. 20 is a waveform diagram showing the drive waveforms for three adjacent lines in the apparatus in FIG. 15.
Figure 21:
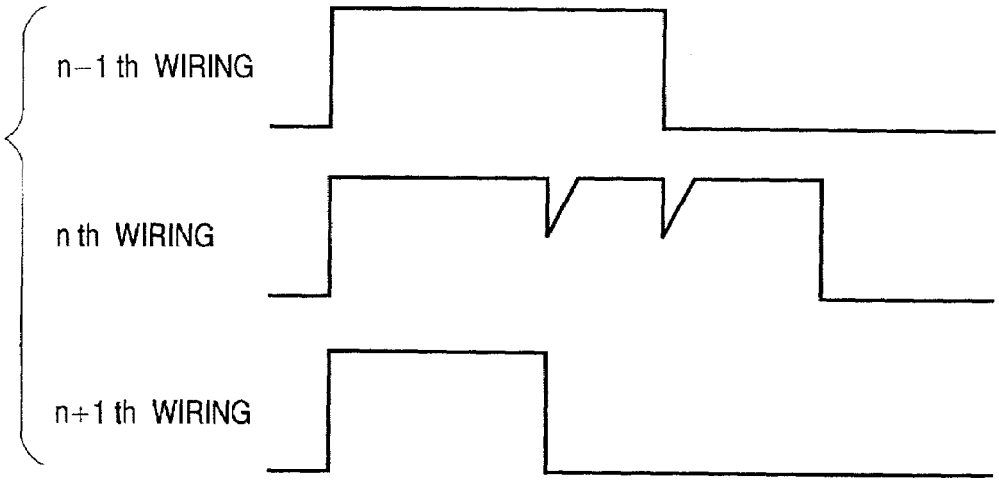

FIG. 1 is a diagram showing the arrangement of an image display apparatus according to a first embodiment of the present invention. The operational timing is the same as that shown in FIG. 16. In FIG. 1, the image display apparatus comprises: a timing controller 1, for generating the operational timing for the apparatus; an A/D converter 2, for converting an input image signal S1 into a digital signal S2 that represents the luminance for each pixel; a column selection controller 3, for controlling a column selection line for a display panel 4; the display panel 4, whereon lines are arranged as columns and rows, and whereon, at intersections of such lines, display devices are disposed; a shift register 5, for distributing the digital luminance signals S2; PWM generators 26, for performing pulse width modulation for the luminance signals transmitted by the shift register 5, and for controlling the display luminance; and a row selection controller 7, which includes the shift register 5 and the PWM generators 26.

With this arrangement, the input image signal S1 is converted by the A/D converter into a digital signal that represents the luminance of each pixel, and the digital signal is transmitted by the shift register 5 to the PWM generators 26 corresponding to the individual pixels. Each of the PWM generators 26 receives not only a luminance signal for its own line, but also a luminance signal for adjacent lines. The PWM generator 26 employs the signal from the timing controller 1 to modulate the luminance signal for its own line into a pulse length, and drives the line arranged as a row on the display panel 4. At the same time, the column selection controller 3 sequentially drives lines arranged as columns that correspond to pixels to be displayed. As a result, the devices on the display panel 4 are driven in accordance with the image signal.

Figure 2:
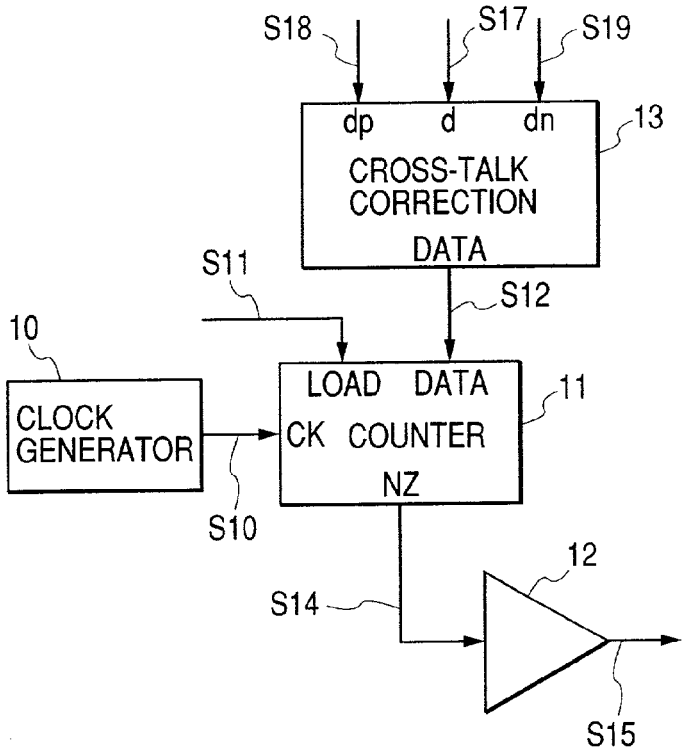
FIG. 2 is a block diagram illustrating the arrangement of a PWM generator in the apparatus in FIG. 1.
Figure 3:
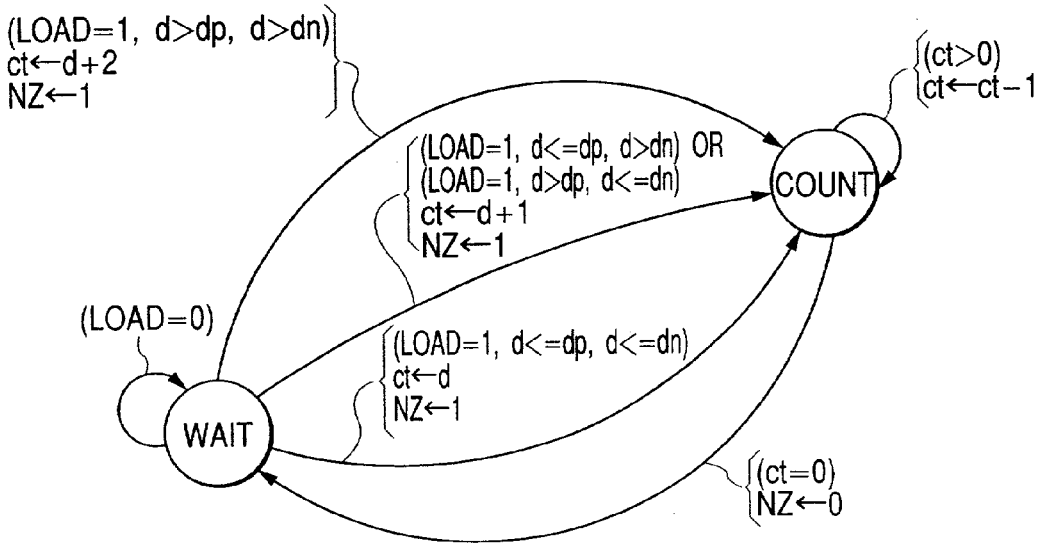
FIG. 3 is a diagram showing the shifting of the operating state of the PWM generator in FIG. 2.
Figure 4:
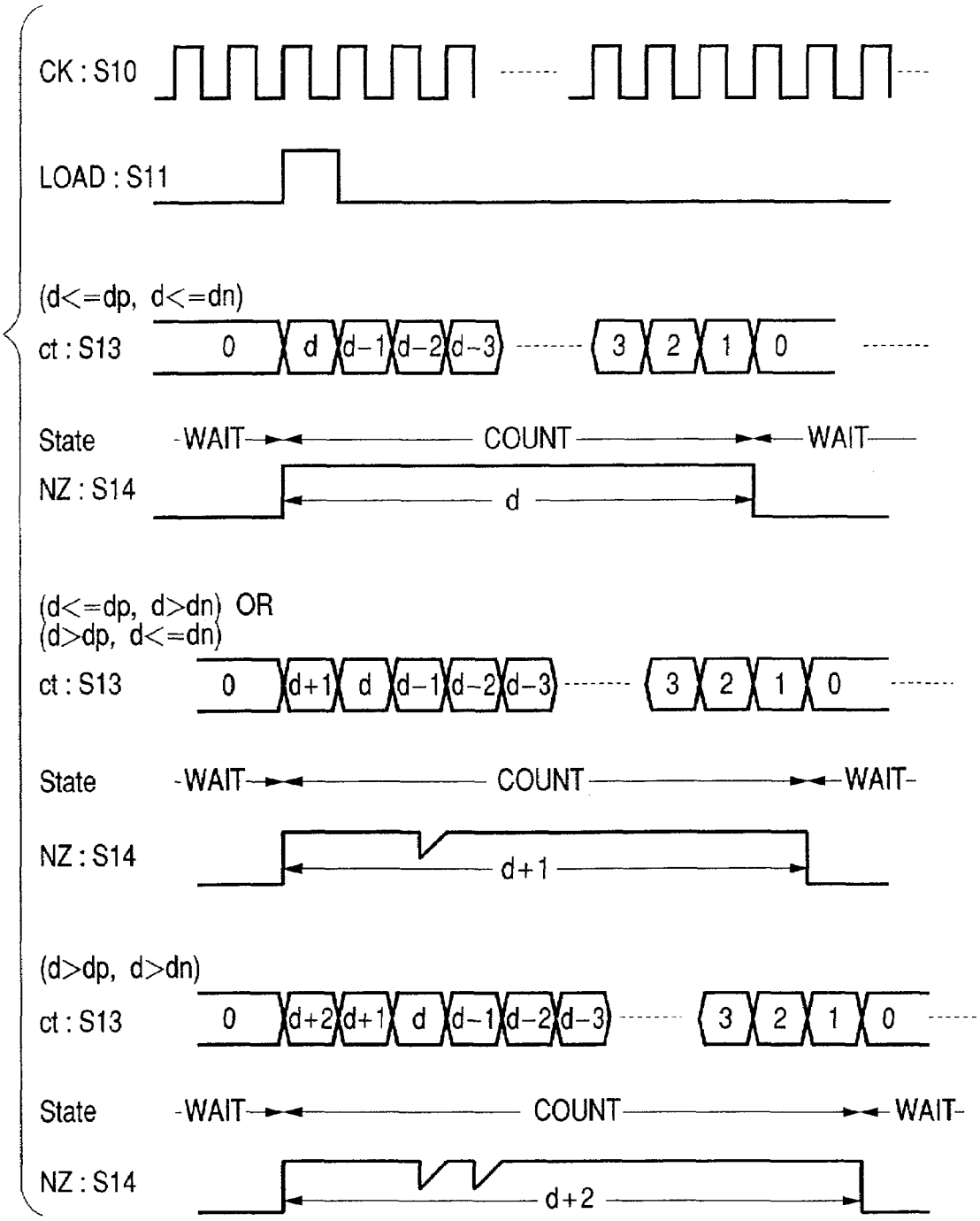
FIG. 4 is a timing chart for the operation of the PWM generator in FIG. 2.

The arrangement of the PWM generator 26 is shown in FIG. 2, the shifting of the operating state is shown in FIG. 3, and the operational timing is shown in FIG. 4. In FIG. 2, a clock generator 10 supplies a clock pulse signal S110 to a down counter 11. Upon receiving the clock pulse signal S10 at the terminal CK, the down counter 11 decrements by one the value held by an internal register ct (not shown). When the counter value reaches 0, the down counter 11 halts the counting and sets the terminal NZ to a high level. When the pulse of a signal S11 is input to the terminal LOAD, the down counter 11 loads the value of DATA input to the internal register and resumes the counting. An output driver 12 receives the level of the terminal NZ of the down counter 11, and drives the display panel 4 (see FIG. 1). A crosstalk correction unit 13 receives, at terminals dp and dn, luminance signals S18 and S19 for adjacent lines, and employs these signals to correct for its own line a luminance signal S17 that is input at terminal d.

The signal S11 is a timing signal for loading the luminance signal S12, and either is a horizontal synchronizing signal, or a signal based on that signal. The signal S12 is a digital luminance signal. The signal S13 in FIG. 4 is the value held by the register ct of the down counter 11. The signal S14 output at the terminal NZ of the down counter 11 is a signal that goes high when the value S13 of the internal register is other than 0. The signal S15 of the output driver 12 is a modulation signal output in accordance with the signal S14. The crosstalk correction unit 13 uses the signal S17, which is a luminance signal that is input at the terminal d, for its own line for which pulse width modulation is to be performed.

The waveform fluctuates due to crosstalk when the signal for an adjacent line goes low earlier than does the line of the crosstalk correction unit 13. Thus, when the luminance signals S18 and S19 for the adjacent lines are lower than the luminance signal S17, the crosstalk correction unit 13 raises the luminance signal for its own line, and extends the pulse length to perform corrections equally. Specifically, suppose that the values of the signals S17, S18 and S19 are dp, d and dn. As is shown in FIG. 3, by using the addition means, d=d+1 is established when d>dp, and also when d>dn, so that the luminance signal is raised by one tone. When d>dp and d>dn, d=d+2 is established, and is employed as an initial value to be loaded to the down counter 11, so that the luminance signal is raised by two tones.

With the above described arrangement and operation, the PWM generators 26 can output a pulse obtained by correcting the fluctuation of the waveform that is caused by crosstalk at the adjacent lines.

In this embodiment, an explanation has been given for a case wherein the pulse width, which is equivalent to the fluctuation of the waveform that occurs when one adjacent line goes low first, is equivalent to one tone. However, even in a case where the equivalent pulse width is another value, such as a value equivalent to two tones, the fluctuation of the waveform can also be corrected by establishing d=d+2 when d>dp. In addition, the internal register ct of the down counter 11 must have a satisfactory number of digits to prevent the occurrence of an overflow, even when a signal d is received after a correction has been made.

Figure 22:
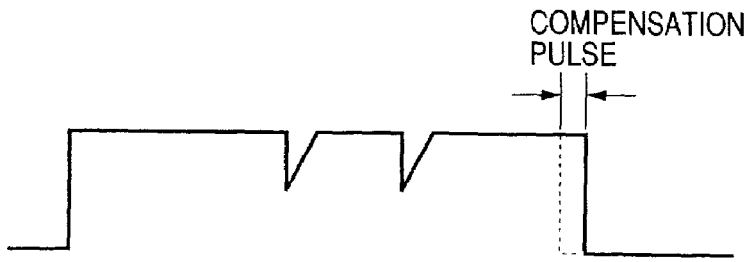
FIG. 22 is a waveform diagram showing a drive waveform in which a compensation pulse is inserted to correct the fluctuation of the waveform caused by the crosstalk in FIG. 21.

Since the luminance signal is corrected based on a correction signal, a compensation pulse shown in FIG. 22, for example, is added that can limit the degree to which the modulation signal is affected by crosstalk. With the added compensation pulse, equal corrections can be provided for the waveform fluctuations attributable to the effect of other lines. Therefore, the display devices are driven by precise pulse width modulation and the affect of the crosstalk that is produced by waveforms on adjacent lines is reduced.

If the values of d relative to three adjacent lines A, B and C are, for example, 99, 100 and 100, the signal transmitted to line B is affected when the signal transmitted to line A rises first, so that under the above described correction control a value of 101 is loaded into the down counter 11. However, the signal transmitted to line C accordingly falls earlier than the signal transmitted to line B. To reduce the effect of such a fall, therefore, the same correction must be performed, based on the signal value obtained after the previous correction, and the initial values for lines A, B and C that are to be loaded into the down counter must be set to 99, 102 and 100.

Second Embodiment

Figure 5:
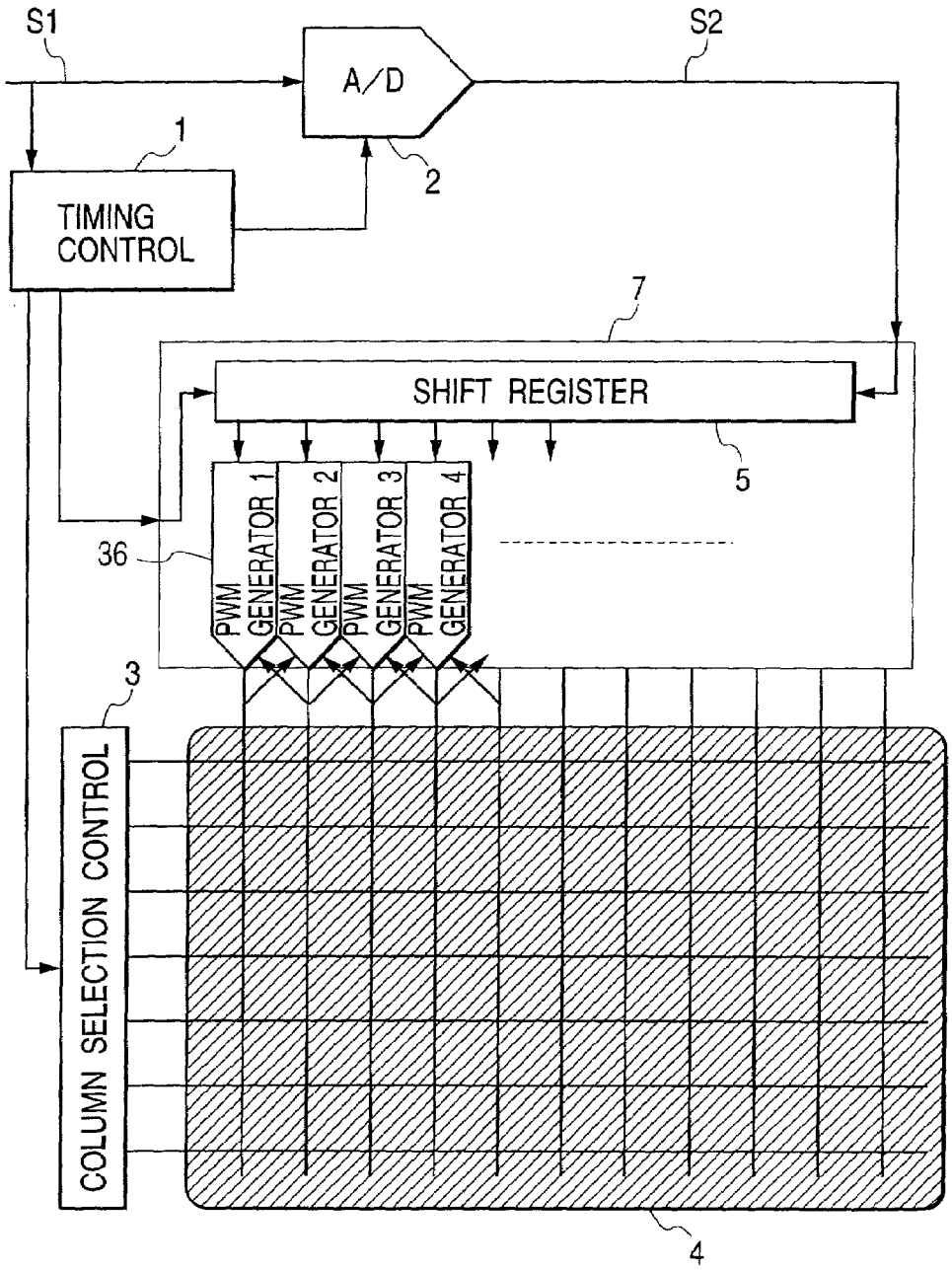
FIG. 5 is a block diagram illustrating the arrangement of an image display apparatus according to a second embodiment of the present invention.

FIG. 5 is a diagram illustrating the arrangement of an image display apparatus according to a second embodiment of the present invention. In this apparatus, the method for correcting a luminance signal and the structure of a PWM generator in the first embodiment are changed. That is, in FIG. 5, each of the PWM generators 36 receives not only a luminance signal for its own line, but also receives signals from the PWM generators 36 on adjacent lines. Other arrangements are the same as those for the first embodiment.

Figure 6:
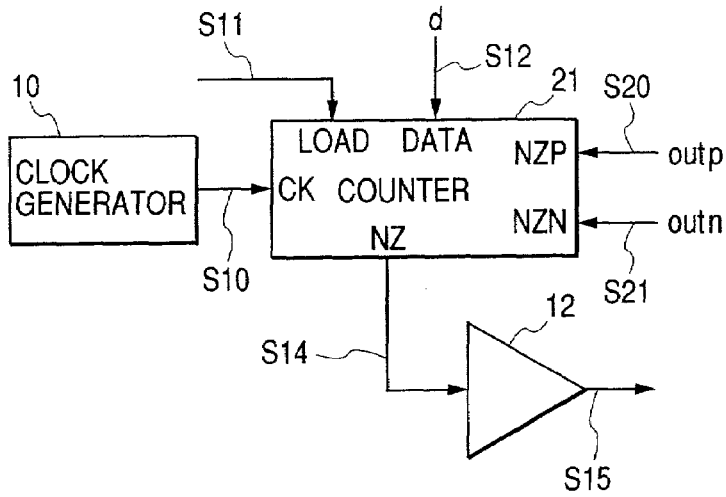
FIG. 6 is a block diagram showing the arrangement of a PWM generator in the apparatus in FIG. 5.
Figure 7:
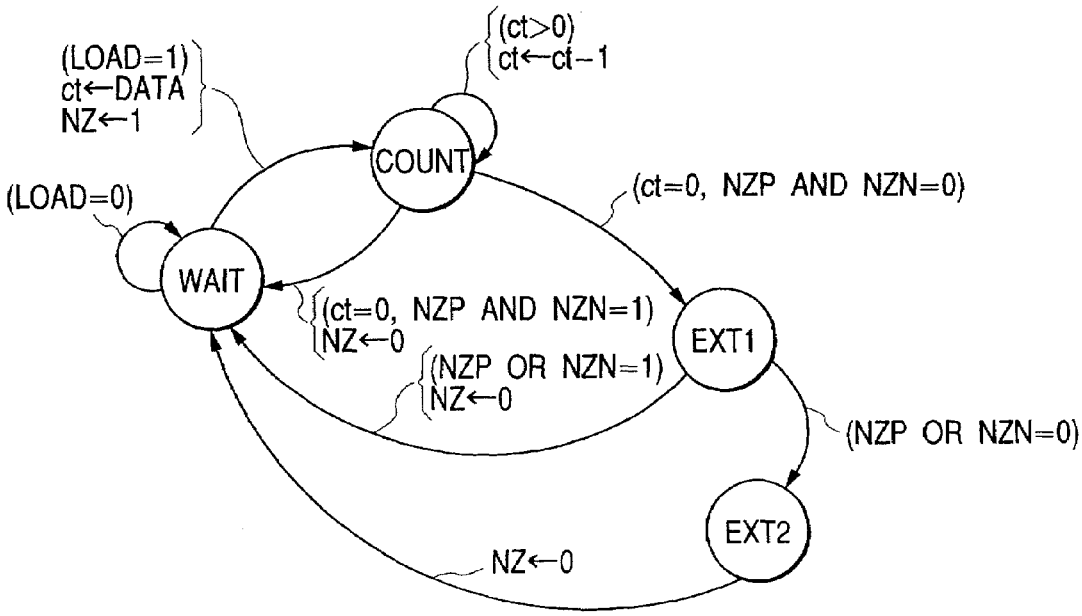
FIG. 7 is a diagram showing the shifting of the operating state of the PWM generator in FIG. 6.
Figure 8:
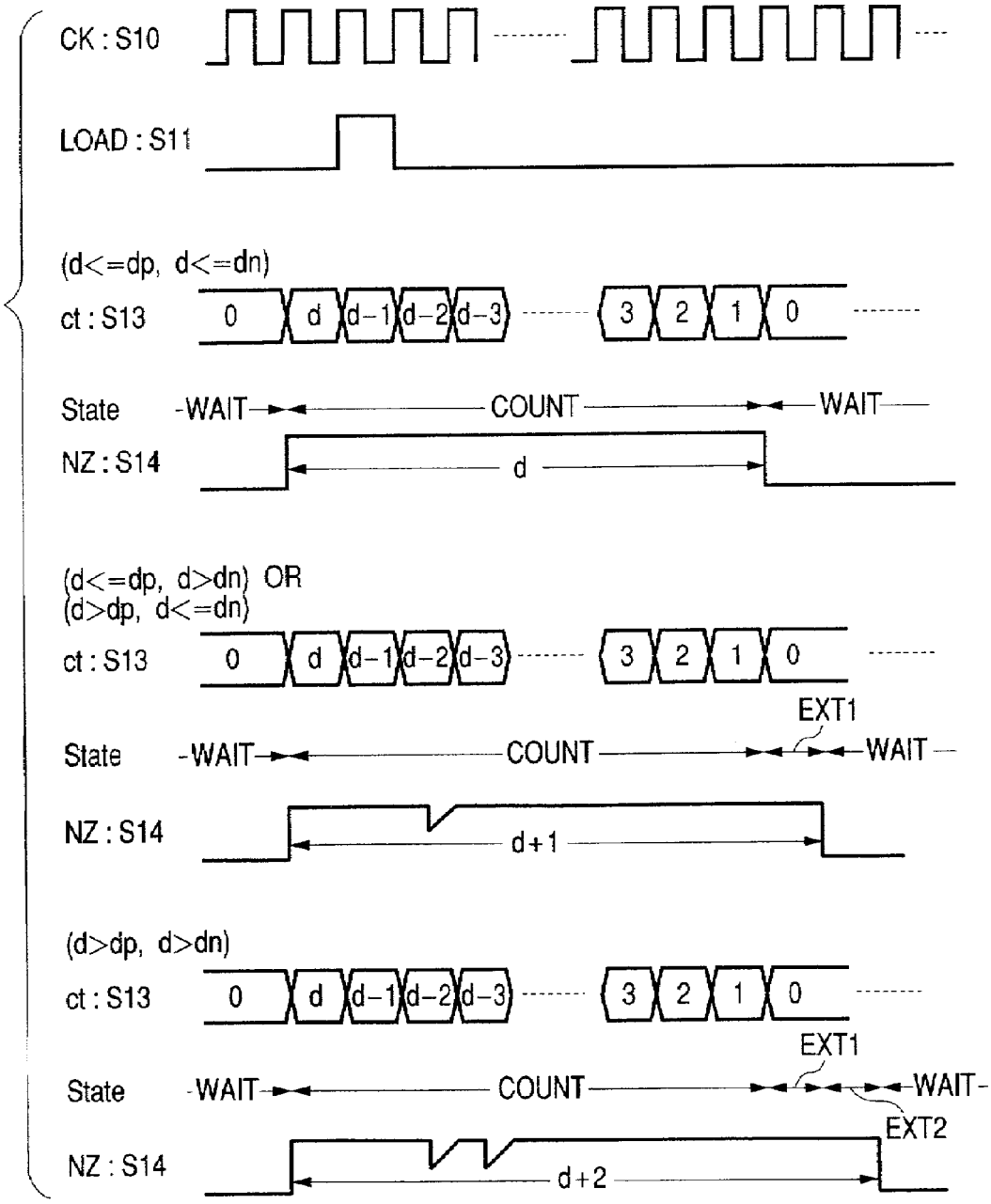
FIG. 8 is a timing chart showing the operation of the PWM generator in FIG. 6.

The structure of a PWM generator 36 is shown in FIG. 6, the shifting of the operating state is shown in FIG. 7, and the operational timing is shown in FIG. 8. In FIG. 6, a down counter 21 is substantially the same as the down counter 11 in FIG. 2, except for the addition of terminals NZP and NZN. The signals output by PWM generators 36 on adjacent lines are input at the terminals NZP and NZN. Although to simplify the drawing in FIG. 5, in the illustration it is indicated that the output signals are fetched directly from the lines, in actuality, a PWM signal S14 output by the down counter 21 is supplied to the terminals NZP and NZN of adjacent PWM generators 36. The remainder of the structure is the same as that shown for the PWM generator in FIG. 2.

With this structure, the down counter 21, which also serves as pulse delay means, decrements the count value, and when the value held by the internal register ct reaches 0, the down counter 21 examines the states of the terminals NZP and NZN. When the level at either terminal NZP or NZN is low, the down counter 21 outputs a pulse equivalent to one clock, and when the levels at both of the terminals NZP and NZN are low, the down counter 21 outputs a pulse equivalent to two clocks. In this manner, the pulse width is extended and the fluctuation of a waveform is corrected. The remaining structures and operations are the same as those for the first embodiment.

Third Embodiment

Figure 12:
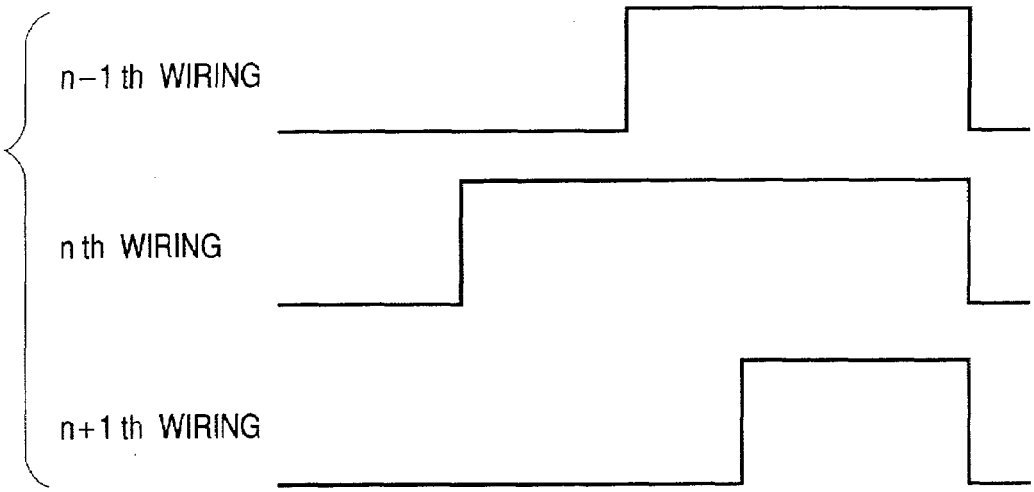
FIG. 12 is a waveform diagram showing waveforms modulated by the PWM generator in FIG. 9.
Figure 13:
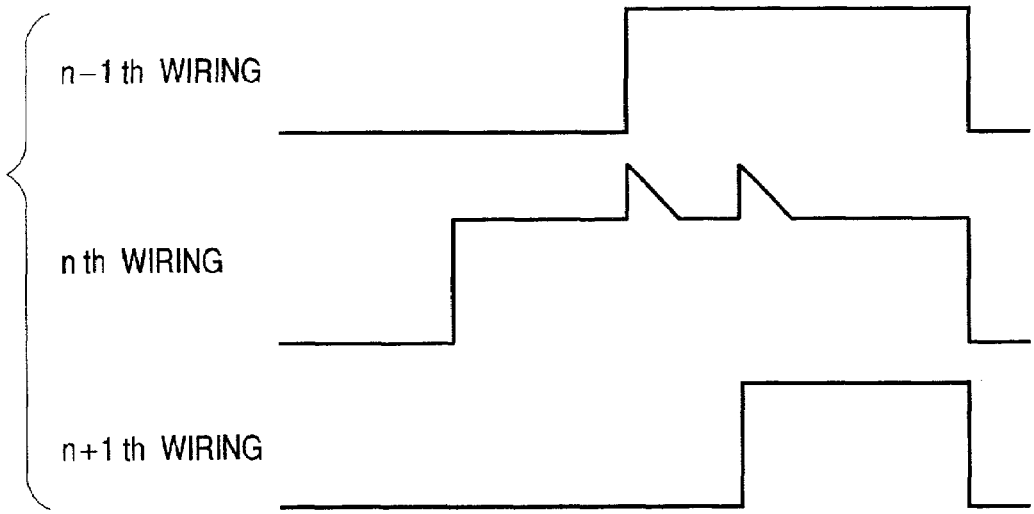
FIG. 13 is a waveform diagram showing the state wherein the waveform in FIG. 12 fluctuates in a direction in which the effective value of a pulse is increased.
Figure 14:
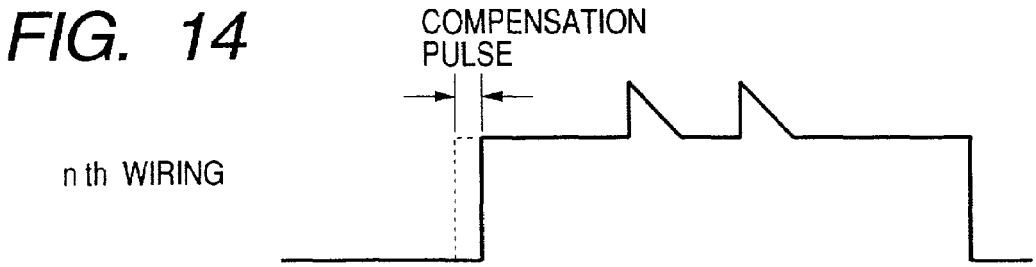
FIG. 14 is a waveform diagram showing the state wherein the waveform in FIG. 13 is corrected.
Figure 15:
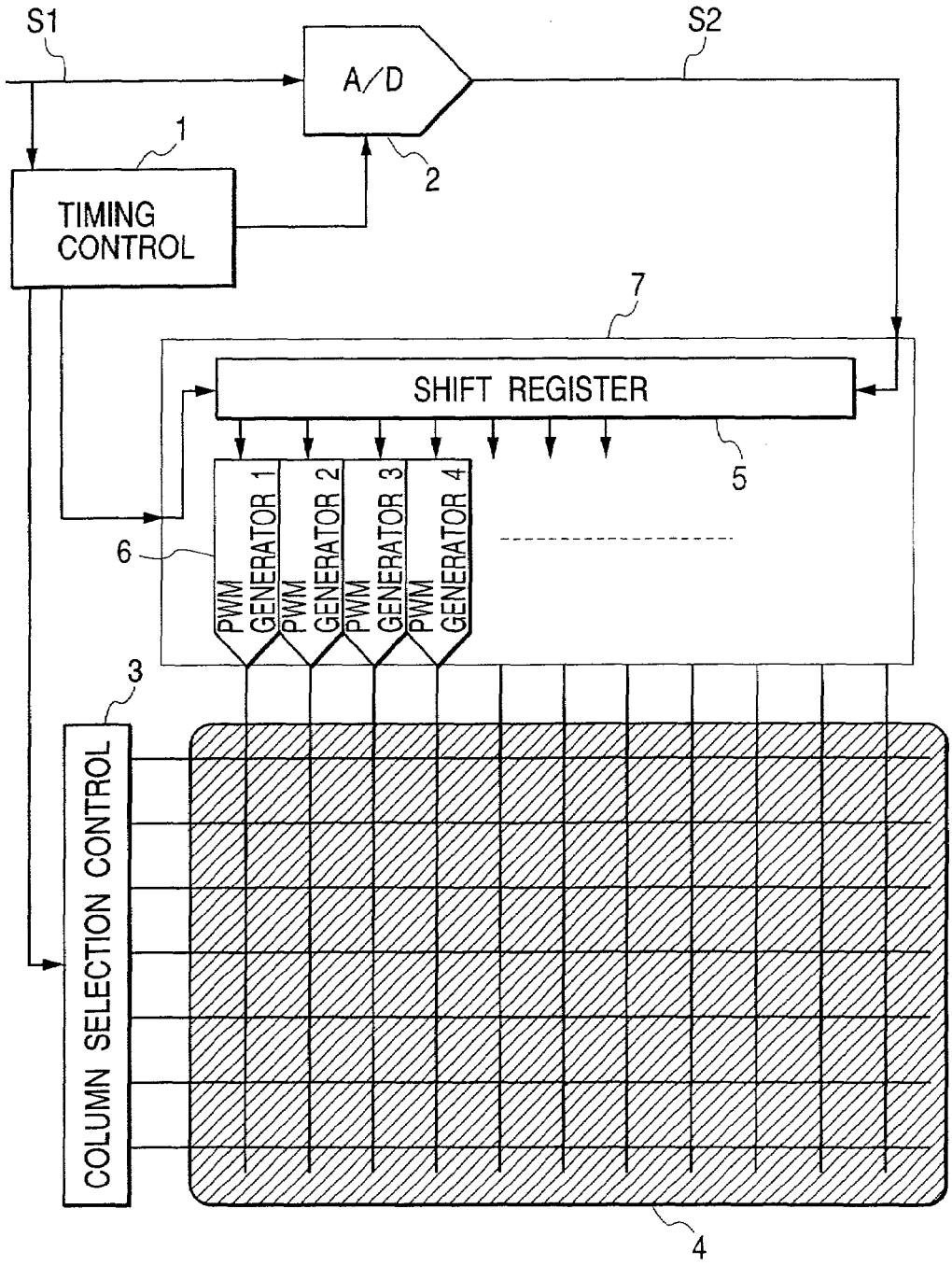
FIG. 15 is a block diagram showing the arrangement of a conventional image display apparatus that uses pulse width modulation to drive a matrix display panel.

In the first embodiment, a PWM generator is employed that outputs modulation waveforms for which the start times for the driving of a modulation signal are identical. In this embodiment, a PWM generator is employed that outputs modulation waveforms, shown in FIG. 12, for which the end times for driving a modulation signal are identical. In this case, the fluctuation of a waveform can be corrected by using an arrangement that is substantially the same. Since, as is shown in FIG. 13, the waveform fluctuates in a direction in which the effective value of a pulse is increased, the PWM generator in this embodiment corrects the fluctuation to reduce the PWM pulse, as is shown in FIG. 14. The overall arrangement of the image display apparatus is the same as that of the first embodiment.

Figure 9:
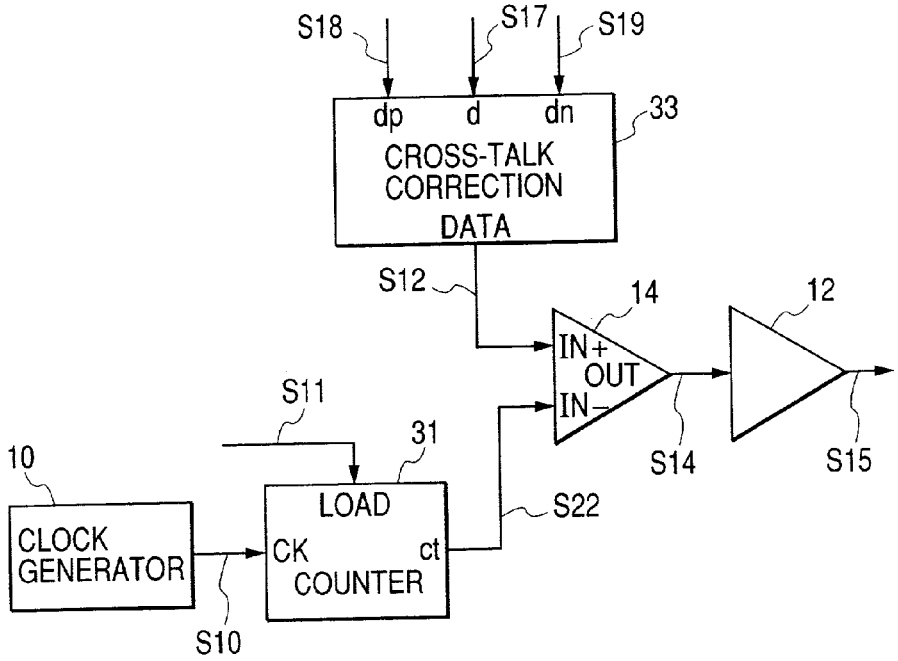
FIG. 9 is a block diagram illustrating the arrangement of a PWM generator according to a third embodiment of the present invention.
Figure 10:
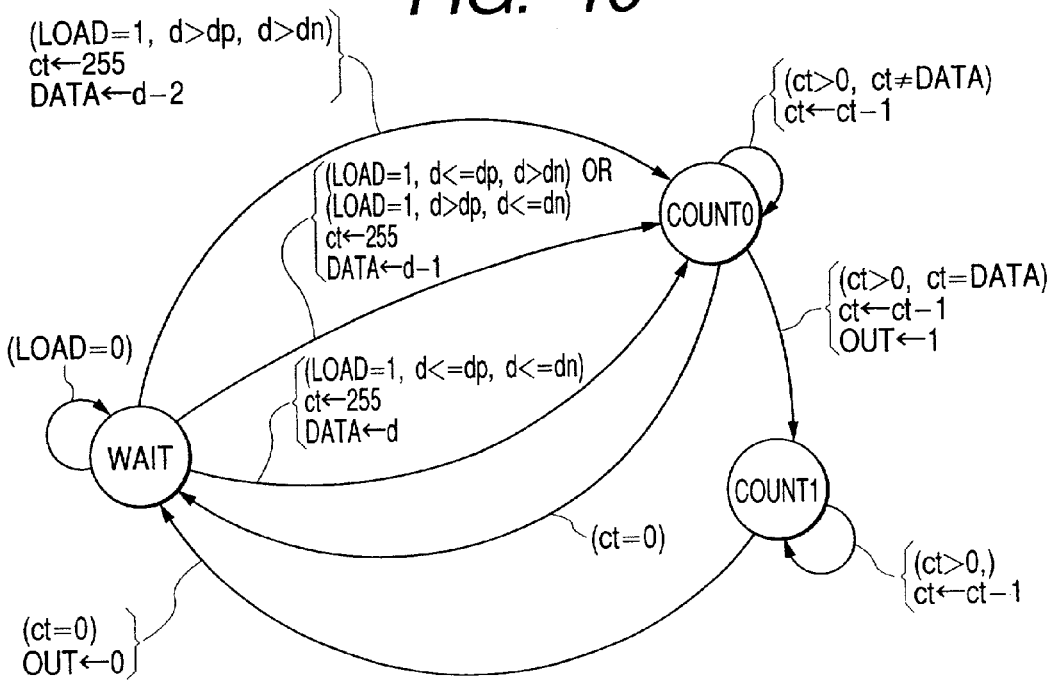
FIG. 10 is a diagram showing the shifting of the operating state of the PWM generator in FIG. 9.

The structure of a PWM generator used for this embodiment is shown in FIG. 9, the shifting of the operating state is shown in FIG. 10, and the operational timing is shown in FIG. 1. In FIG. 9, a comparator 14 outputs to the terminal OUT a value of 1 when (IN+).gtoreq.(IN−) and a value of 0 when (IN+)<(IN−), and also, as a special state, constantly outputs a value of 0 when (IN−)=0. A down counter 31 substitutes 255 into the internal counter ct when the input LOAD goes high, and, based on a clock input CK, decrements the count value until the value held by the internal counter ct reaches 0, at which time the counting is halted. To facilitate this the value S22 held by the counter ct is constantly transmitted to the terminal IN− of the comparator 14. Concurrently, a crosstalk correction unit 33 receives luminance signal S17 for its own line and luminance signals S18 and S19 for adjacent lines, and when the values of the respective luminance signals are dp, d and dn, DATA=d is output to the terminal DATA if d.1toreq.dp and d.1toreq.dn, DATA=d−2 is output if d>dp and d>dn, and DATA=d−1 is output in all other cases.

When the horizontal synchronizing signal S11 is received by the counter 31, the value 255 held by the internal counter ct is decremented. Meanwhile, the comparator 14 compares the output S12 of the crosstalk correction unit 33 with the output S22 of the down counter 31 to obtain the PWM output S14 shown in FIG. 14.

Other arrangements and operations are the same as those in the first embodiment.

In the first to the third embodiments, only the affect of the adjacent lines is taken into consideration. However, if needed, not only the affect of the adjacent lines, but also the affect of the level change of a signal to be transmitted to other lines, such as lines that are adjacent to the aforementioned adjacent lines, may be taken into account.

Further, in the above embodiments, since a correction signal is generated for each line arranged as a row and is employed to correct a luminance signal or a modulation signal, equal corrections can be provided for the fluctuations of drive waveforms that are caused by interference between parallel lines that are arranged as rows.

The arrangements for which the present invention can be applied are not limited to those mentioned in the descriptions of the first to the third embodiments. The present invention can be preferably employed for any arrangement wherein a signal level is substantially affected by a level change for a signal that is transmitted by an adjacent line.

As is described above, according to the present invention, the affect of the fluctuation of a signal that is caused by interference between the lines of an image display apparatus can be reduced.

What is claimed is:

1. A display apparatus comprising:

a plurality of column wirings each connected to a respective display device;

at least one row wiring, connected to said display devices;

a respective pulse width modulator provided for each column wiring for outputting, for each column wiring, a modulation signal; and a cross-talk correction arrangement, which controls operation of the pulse width modulator for a predetermined one of said column wirings such that the modulation signal to be applied to that column wiring is corrected in such manner as to inhibit an effect, on luminance in relation to that modulation signal, of deformation of the waveform of that modulation signal as a result of a level change of the modulation signal supplied to an adjacent column wiring during the application of the modulation signal to the predetermined one of said column wirings, wherein said cross-talk correction arrangement comprises a respective cross-talk correction circuit for each of said column wirings.

2. A display apparatus according to claim 1, wherein each of said display devices comprises an electron-emitting device.

3. A display apparatus according to claim 1, wherein said pulse width modulators each supply a constant current for driving a respective one of said display devices.

4. A display apparatus according to claim 1, wherein when said modulation signal supplied to the adjacent wiring is turned off prior to turning off of the modulation signal from the predetermined pulse width modulator, the modulation signal is corrected to have a longer pulse width.

5. A display apparatus according to claim 1, wherein when the modulation signal supplied to the adjacent wiring is turned on following to turning on of the modulation signal from the predetermined pulse width modulator, the modulation signal is corrected to have a shorter pulse width.

6. A display apparatus according to claim 1, wherein each said cross-talk correction circuit is a part of a respective one of said pulse width modulators.

* * * * *

UNITED STATES PATENT AND TRADEMARK OFFICE

CERTIFICATE OF CORRECTION

PATENT NO. : 7,106,277 B2
APPLICATION NO. : 09/484432
DATED : September 12, 2006
INVENTOR(S) : Muneki Ando et al.

It is certified that error appears in the above-identified patent and that said Letters Patent is hereby corrected as shown below:

COLUMN 1

Line 55, "counter 1" should read --counter 11--.

COLUMN 4

Line 43, "signal S110" should read --signal S10--.

COLUMN 5

Line 40, "affect" should read --effect--.

COLUMN 6

Figure 11:
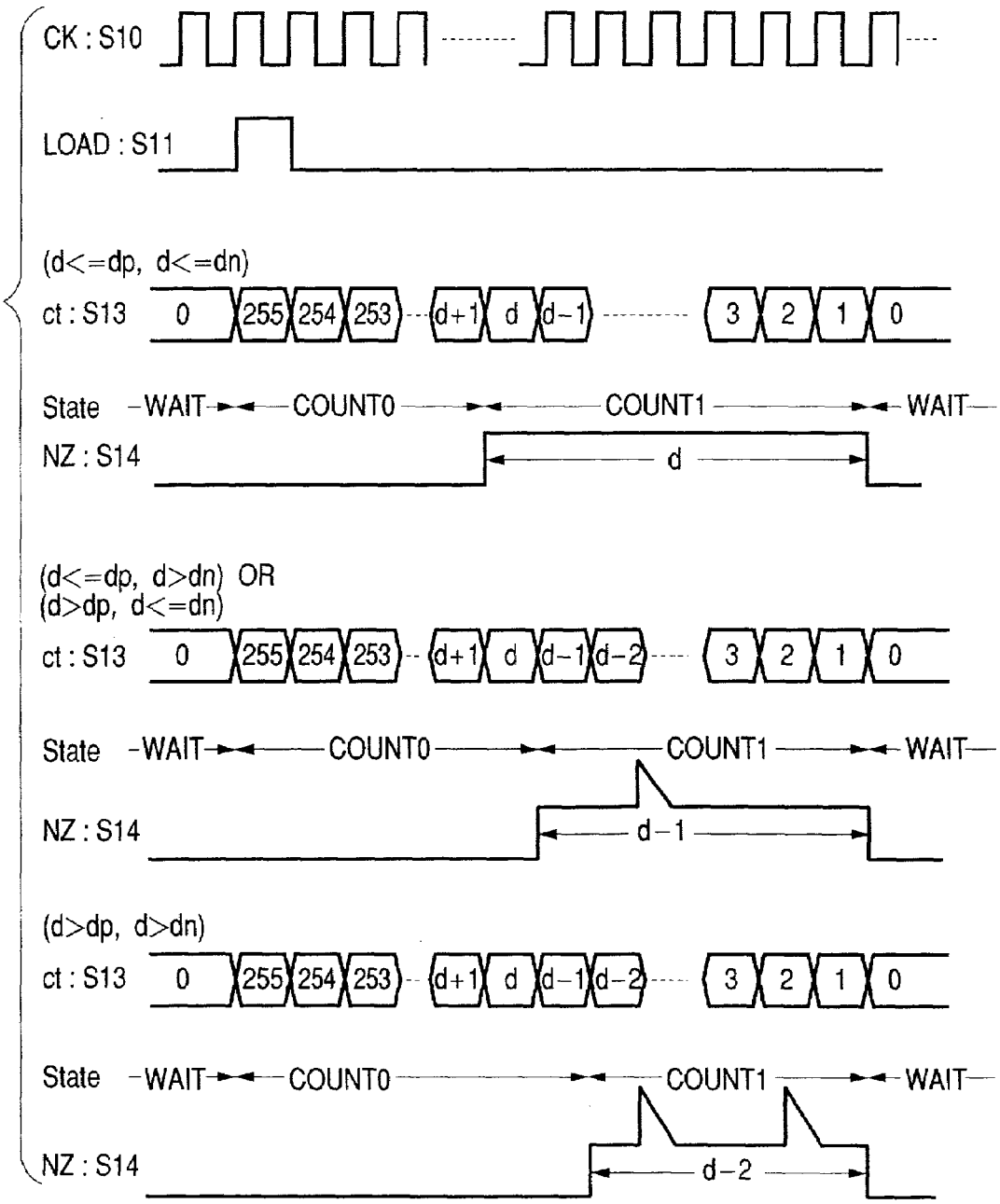
FIG. 11 is a timing chart showing the operation of the PWM generator in FIG. 9.

Line 44, "FIG. 1." should read --FIG. 11.--.

COLUMN 7

Line 3, "affect" should read --effect--.
Line 5, "affect" should read --effect--.
Line 6, "affect" should read --effect--.
Line 22, "affect" should read --effect--.

Signed and Sealed this

Twentieth Day of February, 2007

JON W. DUDAS
*Director of the United States Patent and Trademark Office*